US008267326B2

(12) United States Patent
Kolton et al.

(10) Patent No.: US 8,267,326 B2
(45) Date of Patent: Sep. 18, 2012

(54) TAG FOR BOTTLE NECK HAVING INTEGRAL LOCKING RING

(75) Inventors: Chester Kolton, Westfield, NJ (US); Michael Norman, East Brunswick, NJ (US); Jake Strassburger, South Plainfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 13/178,167

(22) Filed: Jul. 7, 2011

(65) Prior Publication Data

US 2012/0024962 A1 Feb. 2, 2012

Related U.S. Application Data

(60) Provisional application No. 61/362,979, filed on Jul. 9, 2010, provisional application No. 61/362,986, filed on Jul. 9, 2010.

(51) Int. Cl.
*G06K 19/06* (2006.01)

(52) U.S. Cl. ..... 235/492; 235/375; 235/451

(58) Field of Classification Search ..... 235/375, 235/383, 385, 451, 492; 340/10.1, 10.2, 340/572.1, 572.2, 572.7, 572.8; 215/40
See application file for complete search history.

(56) References Cited

U.S. PATENT DOCUMENTS

| | | | | |
|---|---|---|---|---|
| 3,214,808 | A * | 11/1965 | Litwin | 24/16 PB |
| 3,685,676 | A | 8/1972 | Gach et al. | |
| 3,756,444 | A | 9/1973 | McIntosh | |
| 3,853,236 | A | 12/1974 | Ostrowsky | |
| 3,902,339 | A | 9/1975 | Carley et al. | |
| 3,915,326 | A | 10/1975 | Hrubesky | |
| 4,018,640 | A | 4/1977 | Amberg | |
| 4,089,463 | A | 5/1978 | Babiol | |
| 4,176,756 | A | 12/1979 | Gellman | |
| 4,241,188 | A | 12/1980 | Materia et al. | |
| 4,405,161 | A | 9/1983 | Young et al. | |
| 4,457,445 | A | 7/1984 | Hanks et al. | |
| 4,471,982 | A | 9/1984 | Nielsen, Jr. | |
| 4,674,778 | A | 6/1987 | Ruiz | |
| 4,729,487 | A | 3/1988 | Wright | |
| 4,813,564 | A | 3/1989 | Cooper et al. | |
| 5,230,541 | A | 7/1993 | Nowak | |
| 5,602,530 | A | 2/1997 | Holmgren | |
| 5,667,085 | A | 9/1997 | Ogden et al. | |
| 6,098,256 | A | 8/2000 | Poussard | |

(Continued)

FOREIGN PATENT DOCUMENTS

GB 2465892 A 6/2010

(Continued)

*Primary Examiner* — Tuyen K Vo
(74) *Attorney, Agent, or Firm* — Hoffmann & Baron, LLP

(57) ABSTRACT

A tag having an integral locking ring for attachment to a bottle neck with a perimetrical undercut thereabout. The tag includes a housing having upper and lower portions, a retaining device and a cable tie. The housing is formed by an upper housing portion and a lower housing portion that defines an interior. The housing portions have corresponding openings therethrough and corresponding notches that form a passage into the interior. The retaining device is located inside the housing and has an aperture that is adjusted by tightening the cable tie. After the neck of the bottle is inserted through the openings in the housing and the adjustable aperture of the retaining device, the cable tie is tightened to seat the retaining device in the undercut of the neck and secure the tag to the bottle. The housing can also provide support for an electronic security and/or identification device.

21 Claims, 11 Drawing Sheets

U.S. PATENT DOCUMENTS

| | | | | |
|---|---|---|---|---|
| 6,137,413 | A | 10/2000 | Ryan, Jr. | |
| 6,254,139 | B1 | 7/2001 | Fresnel | |
| 6,342,838 | B1 | 1/2002 | Kolton et al. | |
| 6,604,643 | B1 | 8/2003 | Michael et al. | |
| 6,696,955 | B2 | 2/2004 | Kolton et al. | |
| 6,831,552 | B2 | 12/2004 | Lin | |
| D506,694 | S | 6/2005 | Corney | |
| 6,912,878 | B2 * | 7/2005 | Belden, Jr. | 70/57.1 |
| 7,048,179 | B2 | 5/2006 | Claessens et al. | |
| 7,061,382 | B2 | 6/2006 | Claessens et al. | |
| 7,129,841 | B2 | 10/2006 | Feibelman | |
| 7,185,399 | B2 | 3/2007 | Logan | |
| 7,394,383 | B2 | 7/2008 | Hager et al. | |
| 7,650,768 | B2 | 1/2010 | Fawcett et al. | |
| 7,804,405 | B2 | 9/2010 | Norman et al. | |
| 2006/0151414 | A1 | 7/2006 | Mullen | |
| 2006/0180650 | A1 * | 8/2006 | Claessens et al. | 235/375 |
| 2007/0062903 | A1 | 3/2007 | Norman et al. | |
| 2007/0262876 | A1 * | 11/2007 | Marsilio et al. | 340/572.8 |
| 2007/0285243 | A1 | 12/2007 | Feibelman | |
| 2008/0030334 | A1 | 2/2008 | Marsilio et al. | |
| 2008/0048868 | A1 | 2/2008 | Chua et al. | |
| 2008/0230509 | A1 | 9/2008 | Koo et al. | |
| 2008/0289372 | A1 | 11/2008 | Rendon et al. | |
| 2010/0005840 | A1 * | 1/2010 | Hogan et al. | 70/63 |
| 2010/0085191 | A1 | 4/2010 | Kolton et al. | |
| 2010/0133224 | A1 | 6/2010 | Kolton et al. | |
| 2010/0141384 | A1 * | 6/2010 | Chen et al. | 340/10.1 |
| 2010/0253524 | A1 | 10/2010 | Kolton et al. | |
| 2011/0074583 | A1 | 3/2011 | Kolton et al. | |

FOREIGN PATENT DOCUMENTS

| | | | |
|---|---|---|---|
| WO | 2007/086984 | A1 | 8/2007 |
| WO | 2008/075310 | | 6/2008 |

* cited by examiner

SECTION A-A

SECTION A-A

TAG FOR BOTTLE NECK HAVING INTEGRAL LOCKING RING

This application claims priority from provisional application Ser. No. 61/362,979, filed on Jul. 9, 2010, and from provisional application Ser. No. 61/362,986, filed on Jul. 9, 2010, both of which are incorporated herein in their entirety.

FIELD OF THE INVENTION

The present invention relates generally to tags attached to the necks of bottles. More particularly, the present invention relates to a tag that may be applied to bottle necks using a locking ring for securing the tag to the bottle.

BACKGROUND OF INVENTION

Electronic tags attached to articles have a wide variety of uses, including tracking, inventory control and security. These electronic tags can also provide electronically readable information pertaining to the articles.

These tags or markers may include radio frequency identification (RFID) tags or electronic article surveillance (EAS) tags. EAS tags may be used with an alarm system to provide theft deterrence by monitoring the location of the tags and any unauthorized movement of the article containing the EAS tag from a predetermined area. The tags can be enclosed in or attached to a variety of different devices, such as holders or housings, which accommodate the electronic tag and are used to attach the tags to articles. The tags are secured to the article so that they remain with the article until after the time of purchase.

With respect to some articles, such as bottles containing beverages or other liquids, various housings have been developed to secure the tag to different locations on the bottle. A convenient but troublesome location for application of the tags is the outside surface on the necks of bottles. While this is a desirous location to apply the tag, it is difficult to retain the tag thereon, as the tag housing can normally be removed by sliding the housing up over the extending neck.

It is therefore desirable to provide a tag housing which may be secured to the outside surface of a bottle neck and can not be readily removed therefrom.

SUMMARY OF THE INVENTION

In accordance with the present invention, a tag having an integral locking ring for attachment to a bottle neck is provided, wherein the neck has a perimetrical undercut thereabout. The tag includes a housing having upper and lower portions (also referred to herein as the upper housing and the lower housing, respectively), a retaining device and a cable tie. The housing is formed by an upper housing portion and a lower housing portion that defines an interior. The housing portions have corresponding openings therethrough for receiving the neck of the bottle and each housing portion has a perimetrical wall extending from the interior surface to a top edge with corresponding notches that form a passage into the interior when the housing portions are joined together. The lower housing has an edge around the opening and can also include an interior wall offset from and extending circumferentially around the edge.

The retaining device is located inside the housing and has an adjustable aperture that has a diameter and is aligned with the openings in the housing. When the tag is assembled, the openings in the housing portions and the adjustable aperture in the retainer are aligned. The retaining device is secured by a cable tie having a locking mechanism on one end and a tail on the opposite end. The cable tie is disposed around the retaining device and the tail extends through the passage in the housing. After the neck of the bottle is inserted through the openings in the housings and the adjustable aperture of the retaining device, the cable tie is tightened to seat the retaining device in the undercut of the neck to secure the tag to the bottle.

Each housing portion can include one or more latching mechanisms extending from the interior surface. The latching mechanisms in the upper and lower housing portions are correspondingly located and engage each other to attach the housing portions together.

The tag can include a radio frequency identification (RFID) tag or an electronic article surveillance (EAS) tag located inside the housing. This allows the bottle to which the tag is attached to be electronically identified and also provides security against theft.

In a first embodiment, the retaining device is a plurality of flexible fingers. Each finger extends upwardly and inwardly from a base on the edge of the opening of the lower housing portion to a distal end. The opening in the lower housing portion has a diameter and the distal ends of fingers extending from opposing sides of the opening are separated by a distance equal to less than 75% of the diameter of the opening. Each finger has a front surface that contacts the bottle neck and a back surface. Preferably, the distal ends of the flexible fingers extend above the perimetrical wall of the lower housing portion and one or more of the fingers has a spur extending from the back surface and the cable tie is positioned between the bases of the fingers and the spurs. Tightening the cable tie around the plurality of flexible fingers decreases the diameter of the adjustable aperture. The spurs prevent the cable tie from moving above the distal ends of the fingers when the cable tie is tightened.

In a second embodiment, the retaining device is a retainer comprising an annular wall with a gap. The annular wall defines the adjustable aperture and the gap allows the diameter of the adjustable aperture to vary. The retainer has a plurality of opposing members and each member extends outwardly from the annular wall to a distal end. The members are positioned on the annular wall so as to form a track for receiving the cable tie. Preferably, a leg extends from the distal ends of two or more of the members in the direction of the opposing members to capture the cable tie. The retainer is positioned between the edge and the interior wall of the lower housing portion and the cable tie is located between the retainer and the interior wall.

The cable tie is disposed around the retainer and the tail extends through the passage formed in the housing. Tightening the cable tie around the retainer decreases the diameter of the adjustable aperture. After the neck of the bottle is inserted through the openings in the housing portions, the cable tie is tightened to seat the retainer in the undercut of the neck to secure the tag to the bottle.

BRIEF DESCRIPTION OF THE FIGURES

The preferred embodiments of the tag for a bottle neck having an integral locking ring, as well as other objects, features and advantages of this invention, will be apparent from the accompanying drawings wherein.

DETAILED DESCRIPTION OF THE INVENTION

Figure 1:
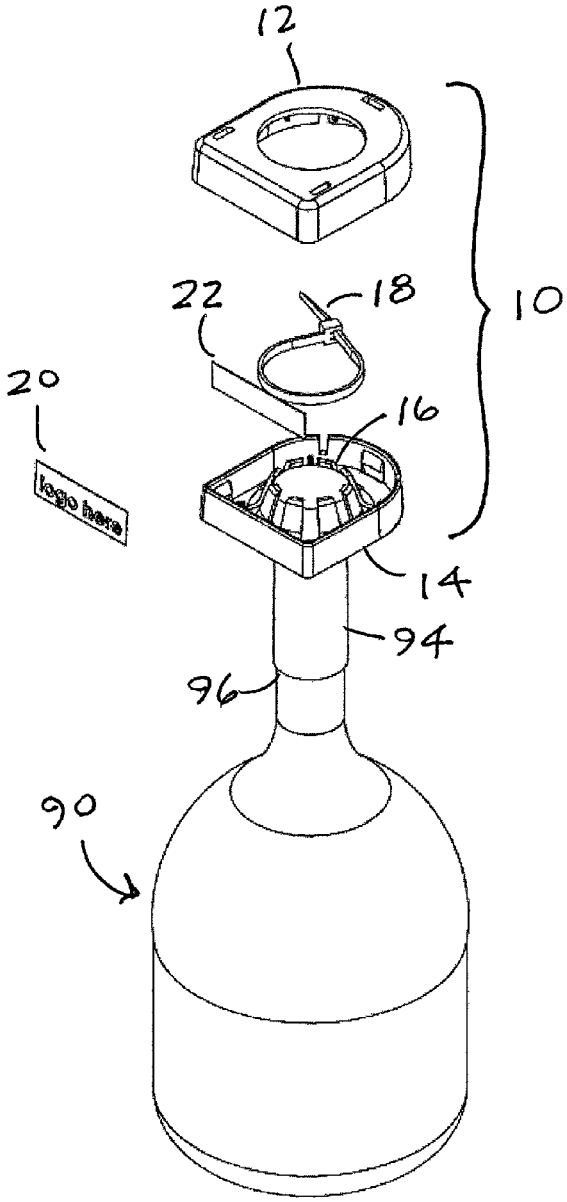
FIG. 1 is an exploded view of a first embodiment of the tag showing the tag being secured to the neck of a bottle.
Figure 2:
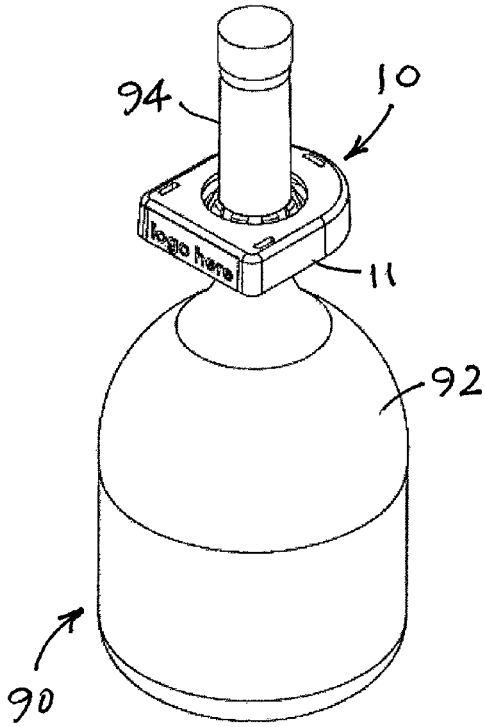
FIG. 2 is a perspective view of the first embodiment of the tag shown in FIG. 1 attached to the neck of a bottle.
Figure 3:
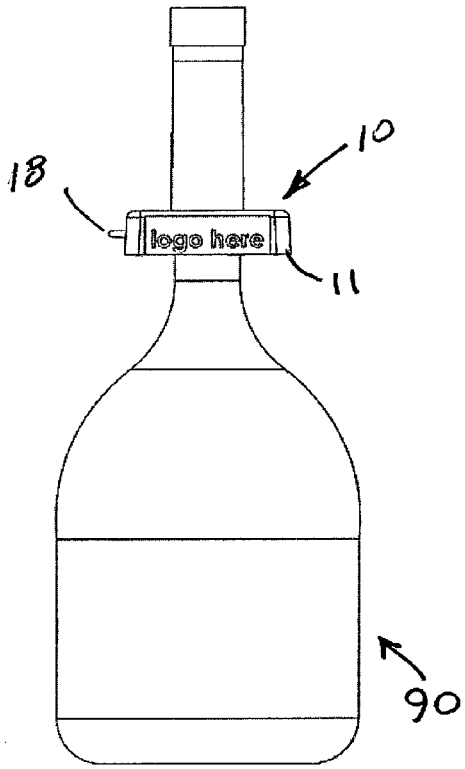
FIG. 3 is a side view of the first embodiment of the tag shown in FIG. 1 secured to the neck of a bottle.
Figure 4:
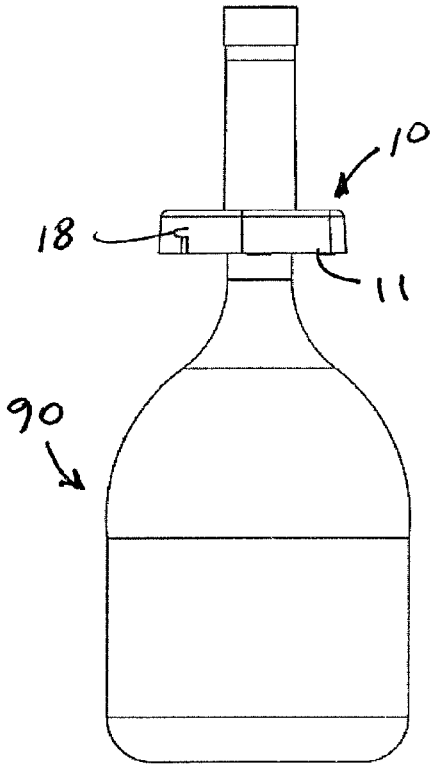
FIG. 4 is a side view of the first embodiment of the tag shown in FIG. 1 secured to the neck of a bottle.
Figure 5:
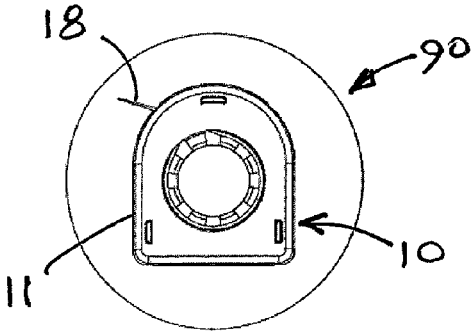
FIG. 5 is a top view of the first embodiment of the tag shown in FIG. 1 attached to the neck of a bottle.

The first embodiment of the tag for a bottle neck having an integral locking ring is described in more detailed with respect to the drawings in FIGS. 1 to 24. FIG. 1 shows an exploded view of the tag 10 being installed on a bottle 90. The tag 10 includes a housing 11 formed by an upper housing portion 12 and a lower housing portion 14, a retaining device 16, a cable tie 18 and, optionally, a label 20 and/or a security device 22. The electronic security device 22 can be an EAS or RFID device that provides electronic identification of the tag 10. The neck 94 of the bottle 90 has a perimetrical undercut 96 located between the base of the neck 94 and its distal end. Below the perimetrical undercut 96, the outer diameter of the neck 94 decreases and provides an attachment point for the tag 10. FIGS. 2-4 show the tag 10 after it is secured to the neck 94 of the bottle 90. FIG. 5 shows a top view of the tag 10 attached to the bottle 90.

Figure 6:
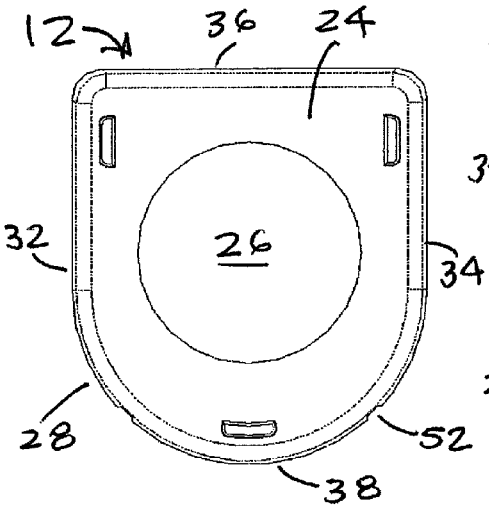
FIG. 6 is a plan view of the exterior of the upper housing of the first embodiment of the tag shown in FIG. 1.
Figure 7:
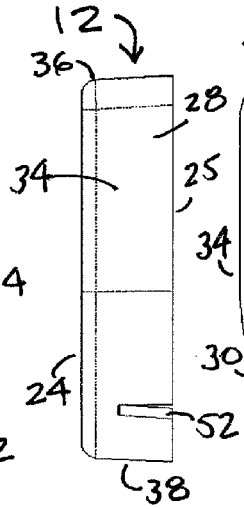
FIG. 7 is a side view of the upper housing of the first embodiment of the tag shown in FIG. 1.
Figure 8:
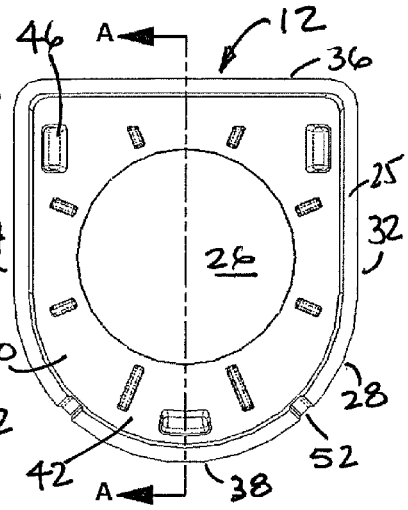
FIG. 8 is a plan view of the interior of the upper housing of the first embodiment of the tag shown in FIG. 1.
Figure 9:
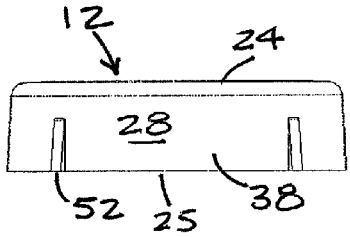
FIG. 9 is a view of the curved end of the upper housing of the first embodiment of the tag shown in FIG. 1.
Figure 10:
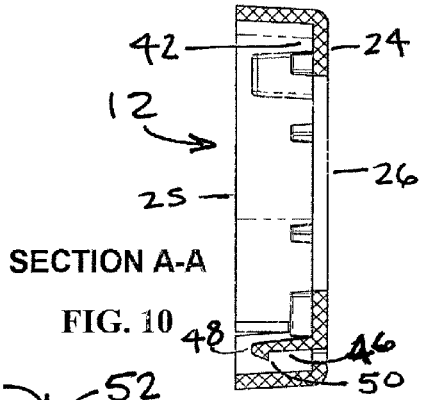
FIG. 10 is a cross-sectional view of section A-A of the upper housing of the first embodiment of the tag shown in FIG. 8.

FIGS. 6-8 show the exterior, side and interior, respectively, of the upper housing 12 of the tag 10. FIG. 9 shows the curved end 38 of the perimeter wall 28. FIG. 10 shows cross-section A-A of the upper housing 12 from FIG. 8. The upper housing 12 has a substantially flat exterior surface 24 with a centrally located opening 26 for receiving the neck 94 of a bottle 90 (see FIG. 1). A perimetrical wall 28 extends from the edge of the exterior surface 24 to a top edge 25 to define an interior 30. The perimetrical wall 28 has two substantially parallel sides 32, 34 connected to two ends 36, 38. The first end 36 is substantially perpendicular to the sides 32, 34 and the second end 38 is curved. A plurality of posts 40 extends substantially perpendicular to the interior surface 42 of the upper housing 12. The posts 40 are offset from and extend around the opening 26. In addition, flexible members 46 extend from the interior surface 42 to distal ends 48. Latching mechanisms 50 (FIG. 10) extend from the distal ends 48 and these latching mechanisms 50 are used to attach the upper housing 12 to the lower housing 14 as described in more detail below.

Figure 11:
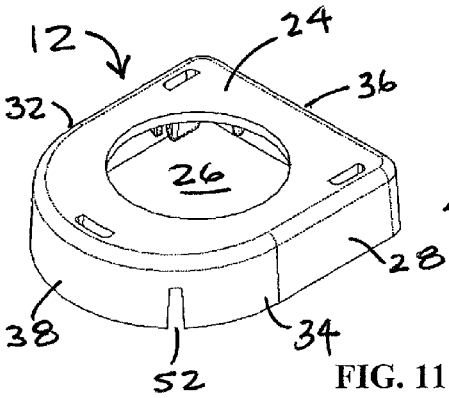
FIG. 11 is a perspective view of the exterior of the upper housing of the first embodiment of the tag shown in FIG. 1.
Figure 12:
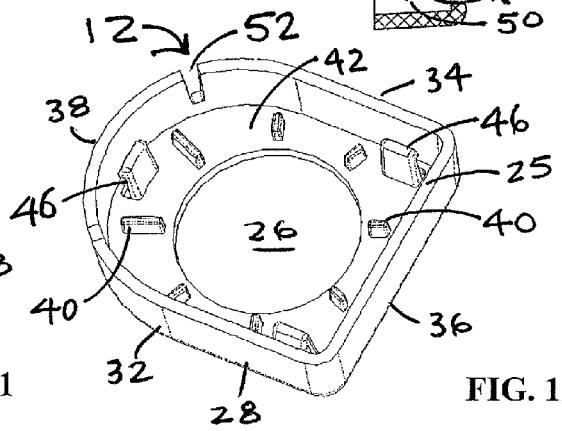
FIG. 12 is a perspective view of the interior of the upper housing of the first embodiment of the tag shown in FIG. 1.

FIGS. 11 and 12 show perspective views of the exterior surface 24 and interior surface 42, respectively, of the upper housing 12 of the tag 10. The curved end 38 of the perimeter wall 28 has one or more notches 52 that form a passage 53 (FIG. 22) in the housing 11 to allow a cable tie 18 to pass through when the upper and lower housing portions 12, 14 are joined together.

Figure 13:
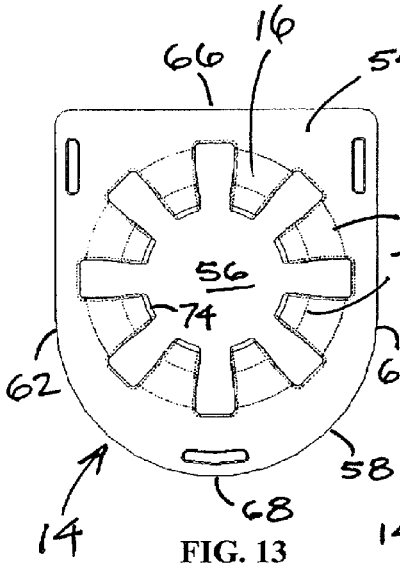
FIG. 13 is a plan view of the exterior of the lower housing of the first embodiment of the tag shown in FIG. 1.
Figure 14:
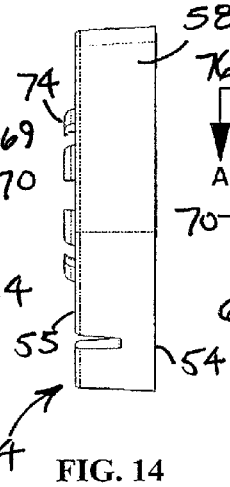
FIG. 14 is a side view of the lower housing of the first embodiment of the tag shown in FIG. 1.
Figure 15:
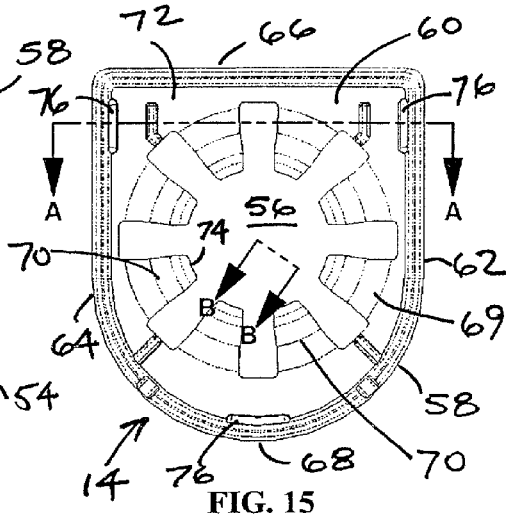
FIG. 15 is a plan view of the interior of the lower housing of the first embodiment of the tag shown in FIG. 1.

FIGS. 13-15 show the exterior, side and interior, respectively, of the lower housing 14 of the tag 10. The lower housing 14 has a substantially flat exterior surface 54 with a centrally located opening 56 for receiving the neck 94 of a bottle 90 (see FIG. 1). A perimetrical wall 58 extends from the edge of the exterior surface 54 to a top edge 55 to define an interior 60. The perimetrical wall 58 has two substantially parallel sides 62, 64 connected to two ends 66, 68. The first end 66 is substantially perpendicular to the sides 62, 64 and the second end 68 is curved. The retaining device 16 is formed by a plurality of flexible fingers 70 around the perimeter of the opening 56. Each flexible finger 70 extends from a base 69 located on the interior surface 72 of the lower housing 14 to a distal end 74. The flexible fingers 70 converge towards the center of the opening 56 so that the distance between the distal ends 74 of the flexible fingers 70 is less than the diameter of the opening 56. Preferably, when a force is applied to move the flexible fingers 70 inwardly, the distal ends 74 contact each other near the center of the opening 56. Accordingly, the flexible fingers 70 have a length (measured from the base 69 to the distal end 74) equal to at least 50% and, preferably more than 75% of the diameter of the opening 56. In addition, members 76 extend from the interior surface 72 to distal ends 78. Latching mechanisms 80 extend from the distal ends 78 and these latching mechanisms 80 (FIG. 20) engage the latching mechanisms 50 on the upper housing 12 to connect the upper housing 12 to the lower housing 14.

Figure 16:
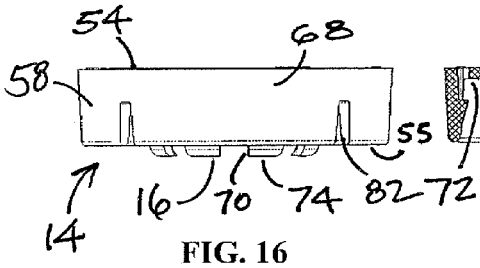
FIG. 16 is an end view of the lower housing of the first embodiment of the tag shown in FIG. 1.
Figure 17:
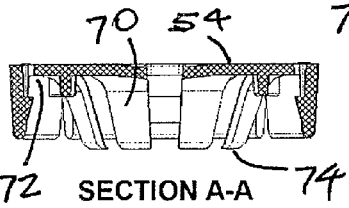
FIG. 17 is a cross-sectional view of section A-A of the lower housing of the first embodiment of the tag shown in FIG. 15.
Figure 18:
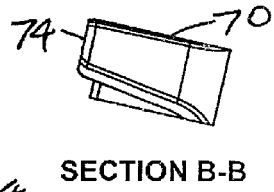
FIG. 18 is a cross-sectional view of section B-B of one of the flexible fingers of the lower housing of the first embodiment of the tag shown in FIG. 15.
Figure 19:
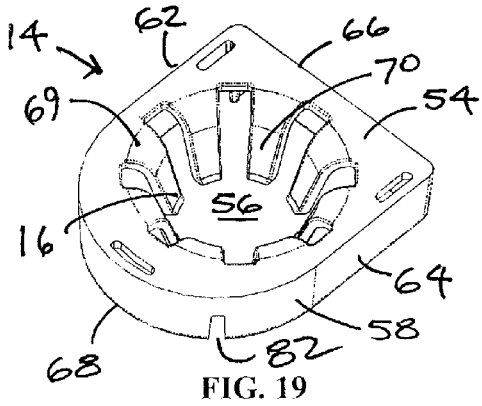
FIG. 19 is a perspective view of the exterior of the lower housing of the first embodiment of the tag shown in FIG. 1.
Figure 20:
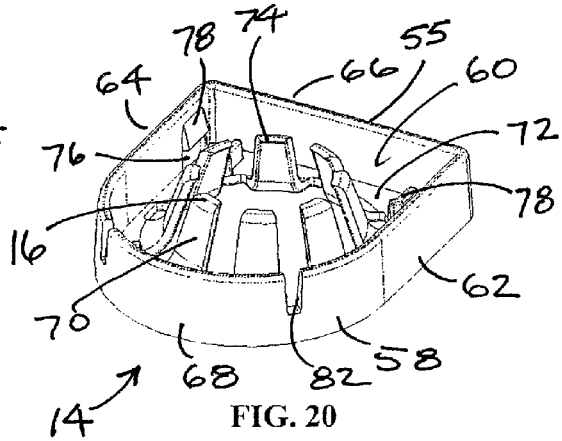
FIG. 20 is a perspective view of the interior of the lower housing of the first embodiment of the tag shown in FIG. 1.

FIG. 16 shows the curved end 66 of the perimeter wall 58 of the lower housing 14 and FIG. 17 shows cross-section A-A of the lower housing 14 from FIG. 15. FIG. 16 shows the distal ends 74 of the flexible fingers 70 that form the retaining device 16 extending above the perimeter wall 58 of the lower housing 14. FIG. 18 shows cross-section B-B of one of the flexible fingers 70 from FIG. 15. FIGS. 19 and 20 show perspective views of the exterior surface 54 and interior surface 72, respectively, of the lower housing 14 of the tag 10. The curved end 68 of the perimeter wall 58 has one or more notches 82 that form a passage 53 to allow a cable tie 18 to pass through the housing 11 when the upper and lower housings 12, 14 are joined together (see FIGS. 1 and 22).

Figure 21:
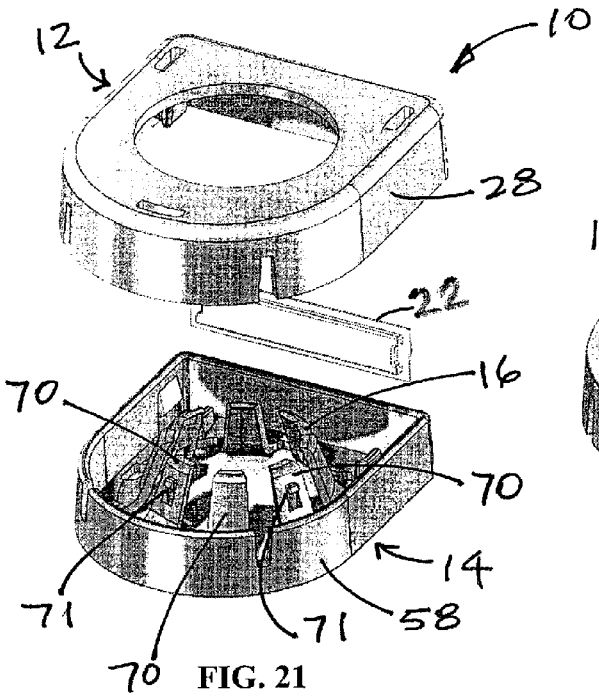
FIG. 21 is an exploded view of the first embodiment of the tag.
Figure 22:
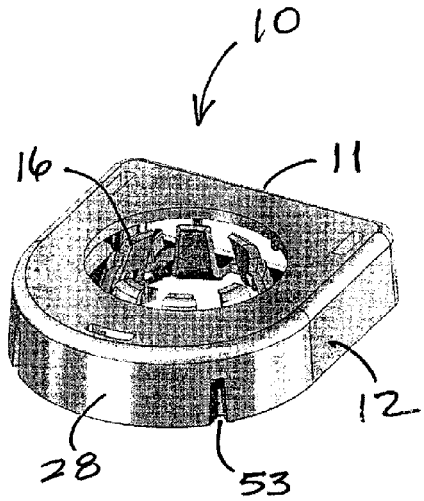
FIG. 22 is a top perspective view of the curved end of the assembled first embodiment of the tag.
Figure 23:
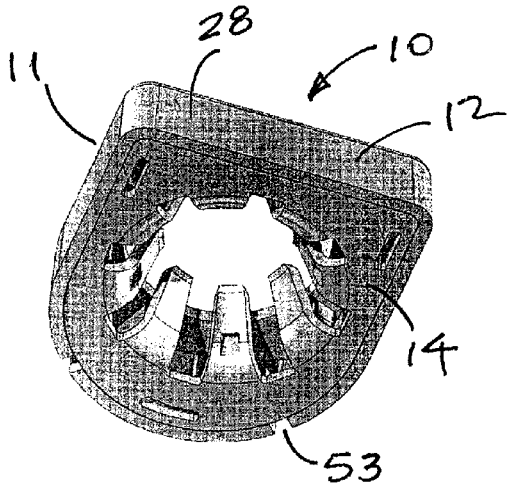
FIG. 23 is a bottom perspective view of the assembled first embodiment of the tag.
Figure 24:
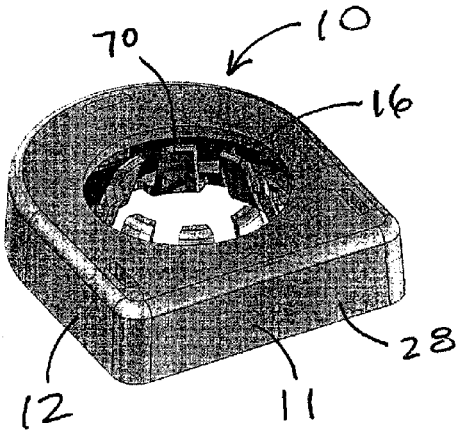
FIG. 24 is a top perspective view of the straight end of the assembled first embodiment of the tag.

FIG. 21 is an exploded view of the tag 10 and shows the upper housing 12, lower housing 14 and a security device 22 installed inside the housing 11. The upper housing 12 is slightly larger than the lower housing 14 so that the perimeter wall 28 of the upper housing 12 fits snugly over and around the perimeter wall 58 of the lower housing 58. However, in other embodiments, the perimeter wall 58 of the lower housing 14 can be dimensioned so that it fits snugly over and around the perimeter wall 28 of the upper housing 12. FIG. 21 also shows a spur 71 extending from the outer surface of some of the flexible fingers 70. The cable tie 18 is positioned over the flexible fingers 70 between the base of the flexible fingers 70 and the spurs 71. When the cable tie 18 is tightened, the spurs 71 prevent the cable tie 18 from sliding up and over the distal ends 78 of the flexible fingers 70. FIGS. 22 and 23 show top and bottom views, respectively, of the assembled housing 11 formed by the upper and lower housings 12, 14 with the passage 53 for the cable tie 18 (not shown—see FIG. 1). FIG. 24 shows a top perspective view of the assembled housing 11 with the retaining device 16 formed by the plurality of flexible fingers 70.

Figure 25:
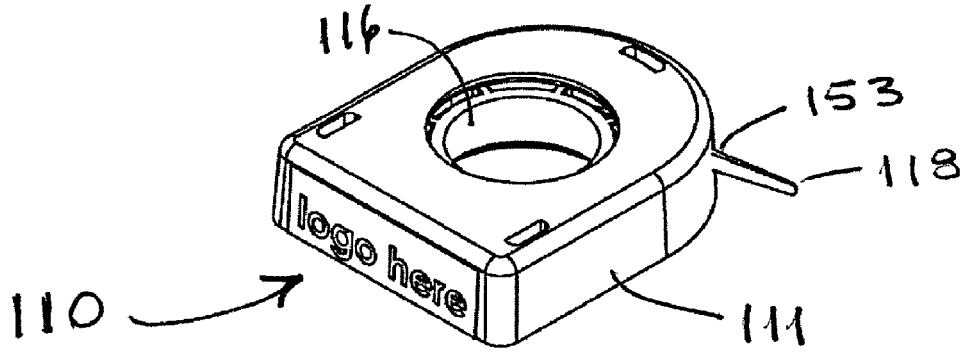
FIG. 25 is a perspective view of a second embodiment of the tag for a bottle neck having a separate locking ring.
Figure 26:
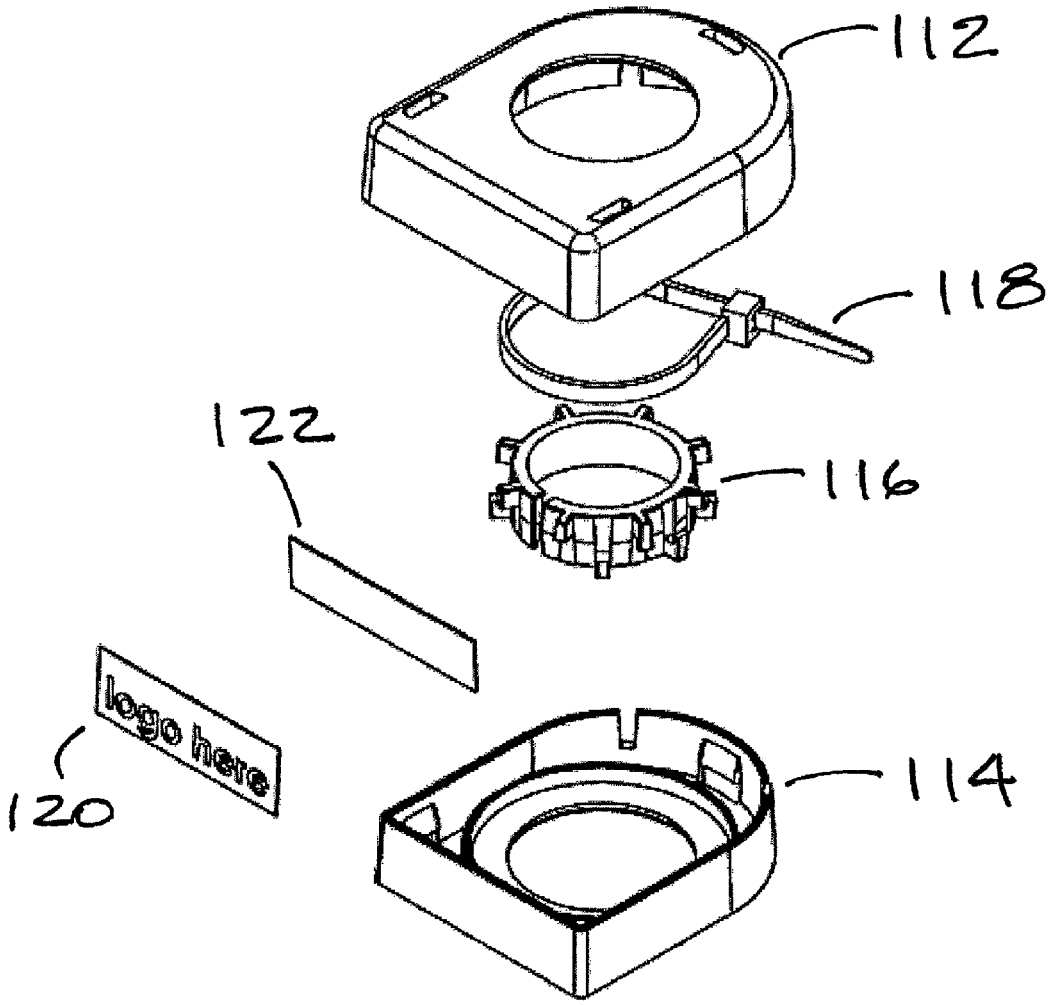
FIG. 26 is an exploded view of the second embodiment of the tag shown in FIG. 25.

The second embodiment of the tag for a bottle neck having a separate locking ring is described in more detailed with respect to the drawings in FIGS. 25 to 56. FIG. 25 shows the tag 110 after all of its components have been assembled. FIG. 26 shows an exploded view of the tag 110 and the individual components. The tag 110 includes a housing 111 formed by an upper housing 112 and a lower housing 114, a retainer 116, a cable tie 118 and optionally a label 120 and/or a security device 122. The upper housing 112 matingly fits over and snugly engages the lower housing 114 with the retainer 116 and cable tie 118 residing inside the housing 111.

Figure 27:
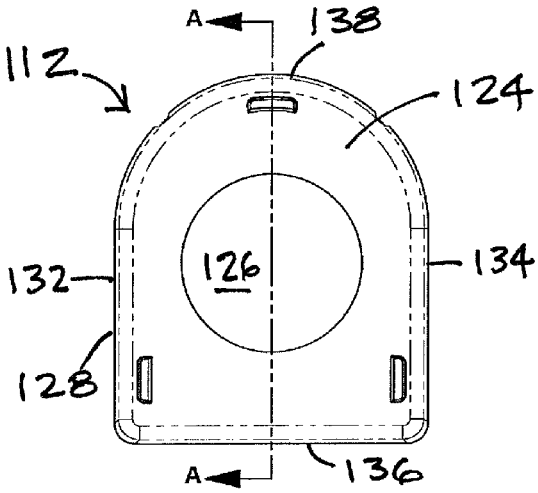
FIG. 27 is a plan view of the exterior of the upper housing of the second embodiment of the tag shown in FIG. 25.
Figure 28:
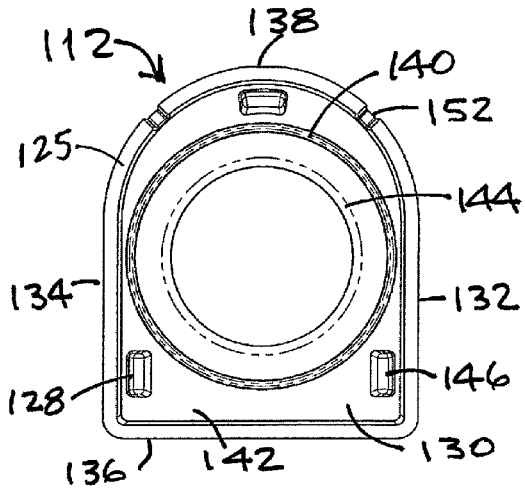
FIG. 28 is a plan view of the interior of the upper housing of the second embodiment of the tag shown in FIG. 25.

FIGS. 27 and 28 show the exterior and interior, respectively, of the upper housing 112 of the tag 110. The upper housing 112 has a substantially flat exterior surface 124 with a centrally located opening 126 for receiving the neck 194 of a bottle 190 (see FIG. 54). A perimetrical wall 128 extends from the edge of the exterior surface 124 to a top edge 125 to define an interior 130. The perimetrical wall 128 has two substantially parallel sides 132, 134 connected to two ends 136, 138. The first end 136 is substantially perpendicular to the sides 132, 134 and the second end 138 is curved. An interior wall 140 extends substantially perpendicular to the interior surface 142 of the upper housing 112. The interior wall 140 is offset from and extends around the opening 126 so as to form a ledge 144 between the interior wall 140 and the opening 126. In addition, flexible members 146 extend from the interior surface 142 to distal ends 148. Latching mechanisms 150 extend from the distal ends 148 and these latching mechanisms 150 are used to attach the upper housing 112 to the lower housing 114 as described above with respect to the housing 11 shown in FIGS. 21-24.

Figure 29:
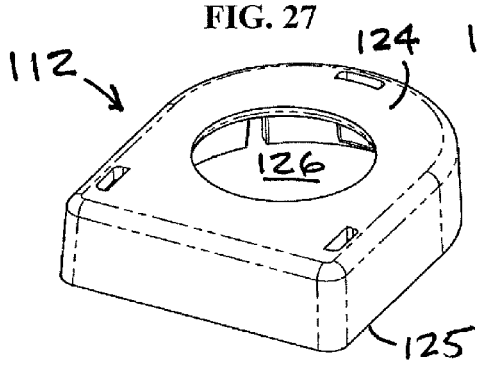
FIG. 29 is a perspective view of the exterior of the upper housing of the second embodiment of the tag shown in FIG. 25.
Figure 30:
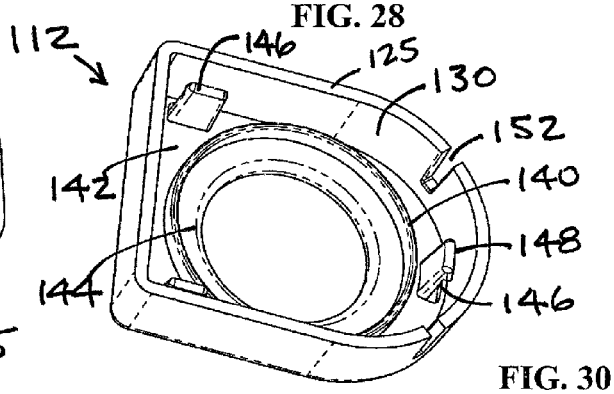
FIG. 30 is a perspective view of the interior of the upper housing of the second embodiment of the tag shown in FIG. 25.
Figure 31:
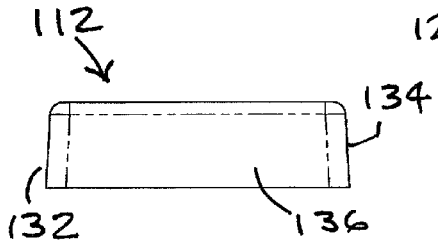
FIG. 31 is an end view of the upper housing of the second embodiment of the tag shown in FIG. 25.
Figure 32:
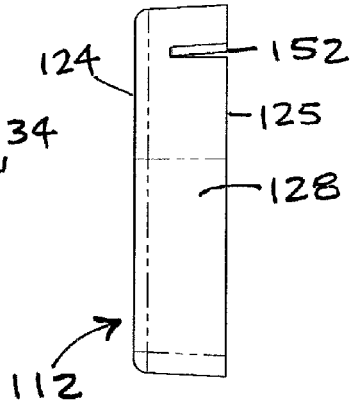
FIG. 32 is a side view of the upper housing of the second embodiment of the tag shown in FIG. 25.
Figure 33:
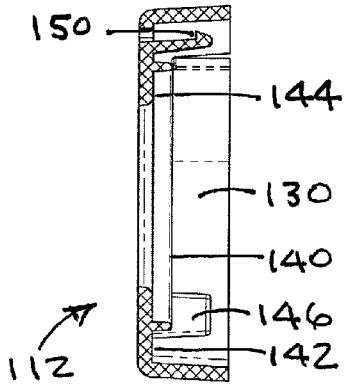
FIG. 33 is a cross-sectional view of section A-A of the upper housing of the second embodiment of the tag shown in FIG. 27.
Figure 49:
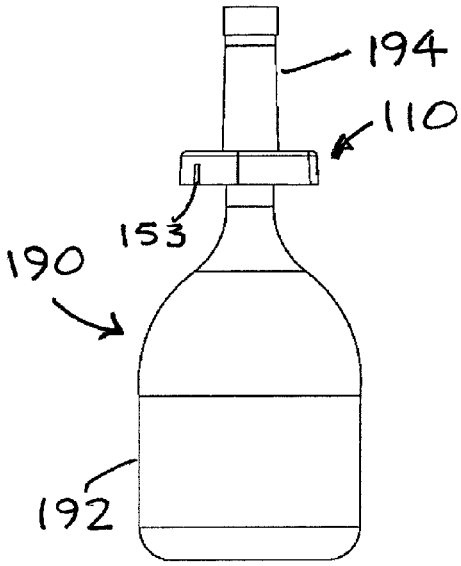
FIG. 49 is a side view of the second embodiment of the tag shown in FIG. 25 secured to the neck of a bottle.
Figure 51:
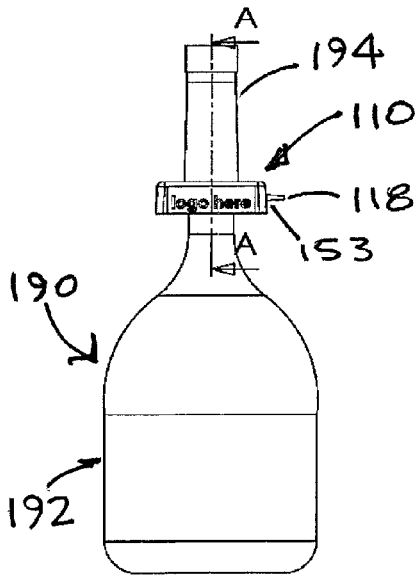
FIG. 51 is a side view of the second embodiment of the tag shown in FIG. 25 secured to the neck of a bottle with section A-A for the bottle neck and tag.

FIGS. 29 and 30 show perspective views of the exterior surface 124 and interior surface 142, respectively, of the upper housing 112 of the tag 110. The curved end 138 of the perimeter wall 128 has one or more notches 152 that form a passage 153 to allow a cable tie 118 to pass through the housing 111 when the upper and lower housings 112, 114 are joined together (FIGS. 25, 49 and 51). FIG. 31 shows the first end 136 of the perimeter wall 128 and FIG. 32 shows one of the sides 132, 134. FIG. 33 shows cross-section A-A of the upper housing 112 from FIG. 27.

Figure 34:
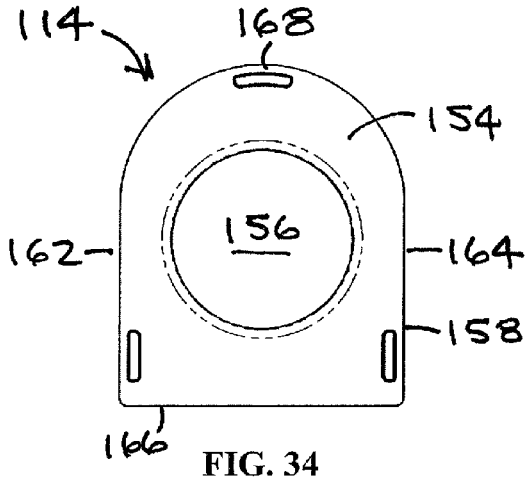
FIG. 34 is a plan view of the exterior of the lower housing of the second embodiment of the tag shown in FIG. 25.
Figure 35:
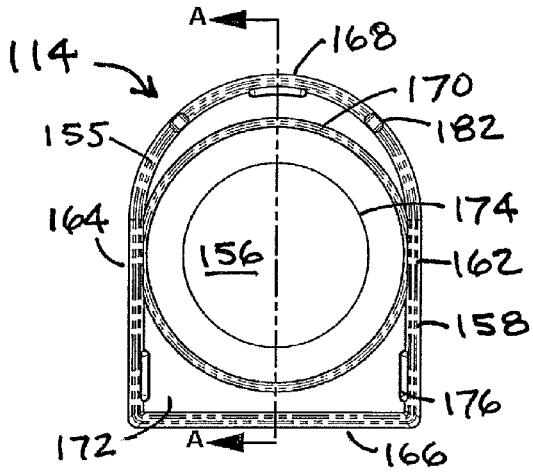
FIG. 35 is a plan view of the interior of the lower housing of the second embodiment of the tag shown in FIG. 25.
Figure 40:
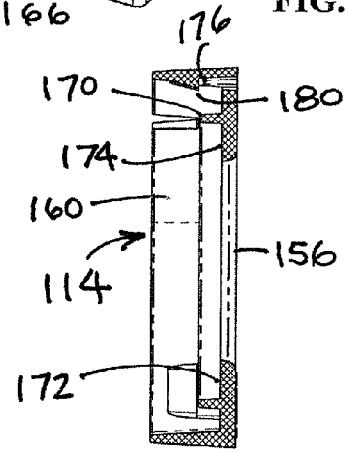
FIG. 40 is a cross-sectional view of section A-A of the lower housing of the second embodiment of the tag shown in FIG. 35.

FIGS. 34 and 35 show the exterior and interior, respectively, of the lower housing 114 of the tag 110. The lower housing 114 has a substantially flat exterior surface 154 with a centrally located opening 156 for receiving the neck 194 of a bottle 190 (see FIG. 54). A perimetrical wall 158 extends from the edge of the exterior surface 154 to a top edge 155 to define an interior 160. The perimetrical wall 158 has two substantially parallel sides 162, 164 connected to two ends 166, 168. The first end 166 is substantially perpendicular to the sides 162, 164 and the second end 168 is curved. An interior wall 170 extends substantially perpendicular to the interior surface 172 of the lower housing 114. The interior wall 170 is offset from and extends around the opening 156 so as to form a ledge 174 between the interior wall 170 and the opening 156. In addition, members 176 extend from the interior surface 172 to distal ends 178 that include latching mechanisms 180 (FIG. 40). These latching mechanisms 180 engage the latching mechanisms 150 on the upper housing 112 and connect the upper housing 112 to the lower housing 114.

Figure 36:
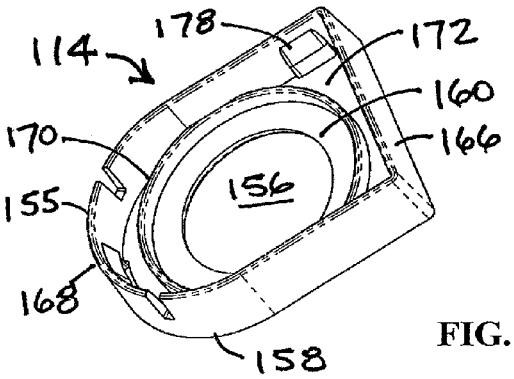
FIG. 36 is a side perspective view of the interior of the lower housing of the second embodiment of the tag shown in FIG. 25.
Figure 37:
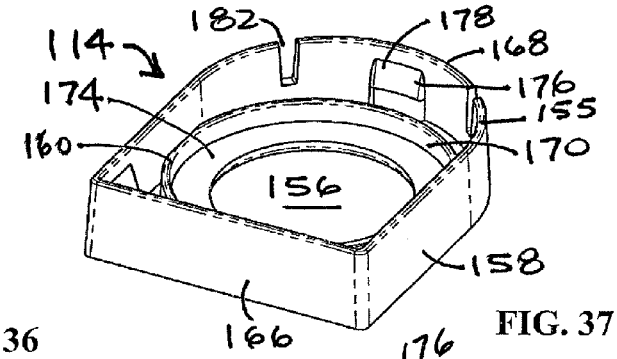
FIG. 37 is an end perspective view of the interior of the lower housing of the second embodiment of the tag shown in FIG. 25.
Figure 38:
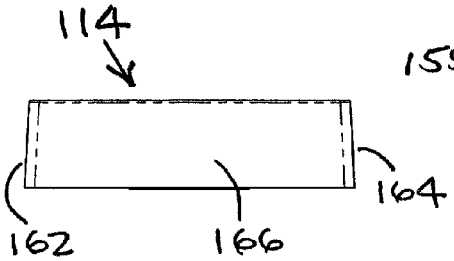
FIG. 38 is an end view of the lower housing of the second embodiment of the tag shown in FIG. 25.
Figure 39:
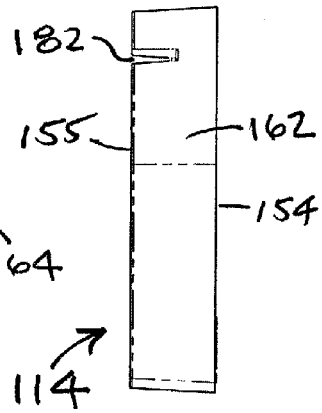
FIG. 39 is a side view of the lower housing of the second embodiment of the tag shown in FIG. 25.

FIGS. 36 and 37 show perspective views of the interior surface 172 of the lower housing 114 of the tag 110. The curved end 168 of the perimeter wall 158 has one or more notches 182 that form a passage 153 to allow a cable tie 118 to pass through the housing 111 when the upper and lower housings 112, 114 are joined together (FIGS. 25, 49 and 51). FIG. 38 shows the first end 166 of the perimeter wall 158 and FIG. 39 shows one of the sides 162. FIG. 40 shows cross-section A-A of the lower housing 114 from FIG. 35. FIG. 40 shows the interior wall 170 and one of the members 176 with the latching mechanism 180 for connecting the upper and lower housings 112, 114 together.

Figure 41:
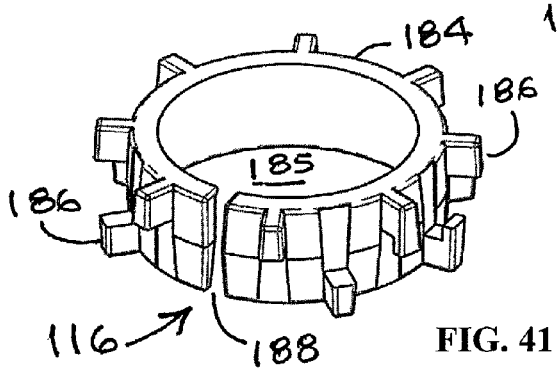
FIG. 41 is a side perspective view of the retainer for the second embodiment of the tag shown in FIG. 26.
Figure 42:
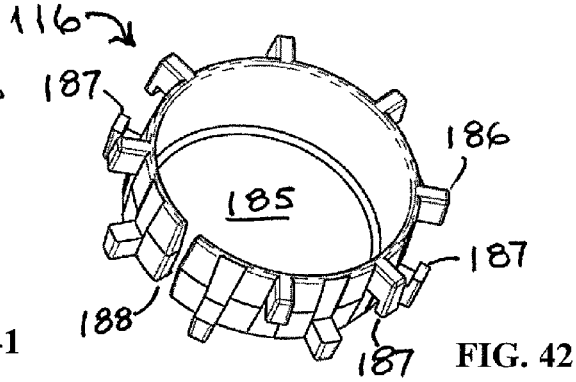
FIG. 42 is a top perspective view of the retainer for the second embodiment of the tag shown in FIG. 26.

FIGS. 41 and 42 are perspective views of the retainer 116, which has an annular wall 184 with a plurality of members 186 extending outwardly therefrom. The retainer 116 also has an aperture 185 for receiving the neck 194 of a bottle 190 (see FIG. 54) and a gap 188 in the annular wall 184. The members 186 are located on upper and lower portions of the annular wall 184 and some of the members 186 have legs 187 on the ends. The legs 187 on the lower portions of the annular wall 184 and the legs 187 on the upper portions of the annular wall 184 are directed towards each other to form a track 189 (FIG. 45) around the annular wall 184 for receiving a cable tie 118 (see FIG. 26). After the neck 194 is inserted in the aperture 185 in the retainer 116, the cable tie 118 is tightened and the gap 188 allows the diameter of the retainer 116 to decrease so that the retainer 116 can be firmly secured around the neck 194 of the bottle 190.

Figure 43:
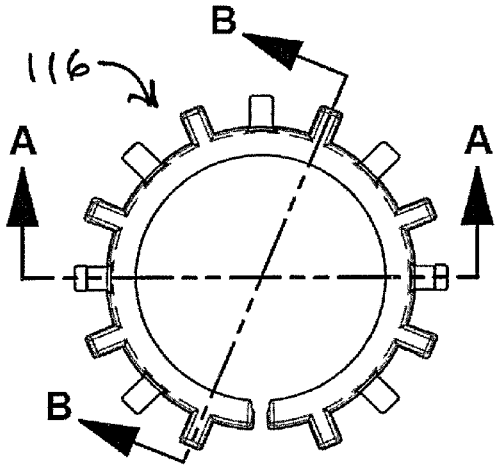
FIG. 43 is a top plan view of the retainer for the second embodiment of the tag shown in FIG. 26.
Figure 44:
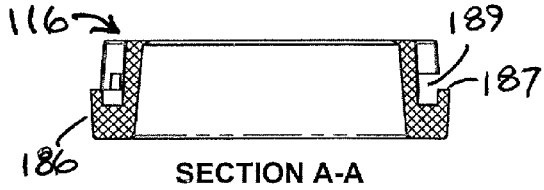
FIG. 44 is a cross-sectional view of section A-A of the retainer for the second embodiment of the tag shown in FIG. 43.
Figure 45:
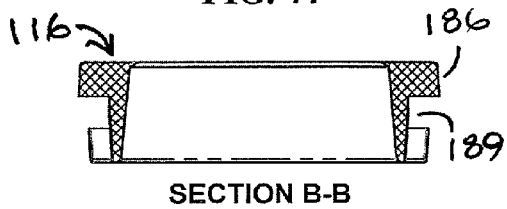
FIG. 45 is a cross-sectional view of section B-B of the retainer for the second embodiment of the tag shown in FIG. 43.
Figure 46:
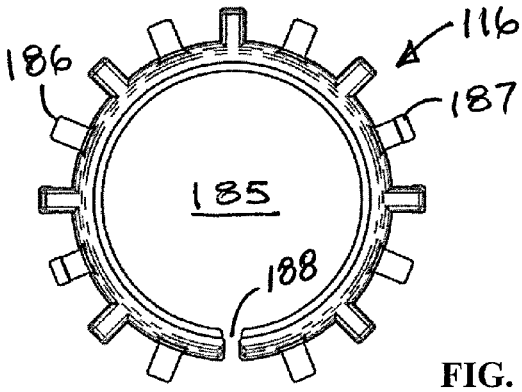
FIG. 46 is a bottom plan view of the retainer for the second embodiment of the tag shown in FIG. 26.
Figure 47:
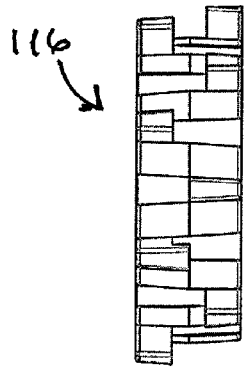
FIG. 47 is a side view of the retainer for the second embodiment of the tag shown in FIG. 26.
Figure 48:
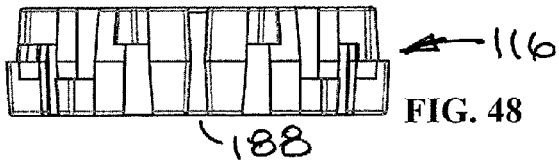
FIG. 48 is side view of the open side of the retainer for the second embodiment of the tag shown in FIG. 26.

FIG. 43 shows the top of the retainer 16 and cross-sections A-A and B-B. FIGS. 44 and 45 show cross-section A-A and cross-section B-B, respectively, and illustrate how track 189 is formed for receiving the cable tie 118. The track 189 prevents the cable tie 118 from slipping off the retainer 116 (see FIGS. 52-54). FIG. 46 shows the bottom of the retainer 116 and FIGS. 47 and 48 show side views of the retainer 116.

Figure 50:
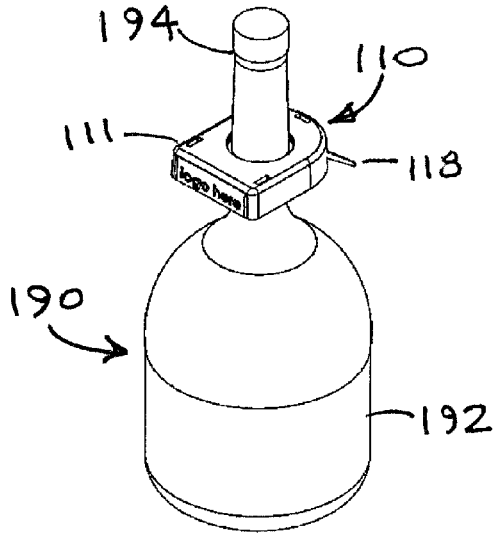
FIG. 50 is a perspective view of the second embodiment of the tag shown in FIG. 25 secured to the neck of a bottle.
Figure 52:
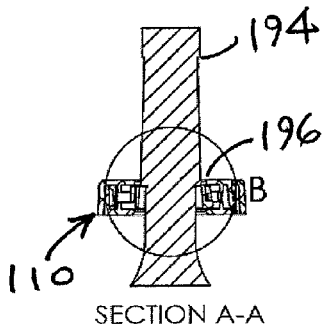
FIG. 52 is a cross-sectional view of section A-A of the bottle neck and the second embodiment of the tag shown in FIG. 51.
Figure 53:
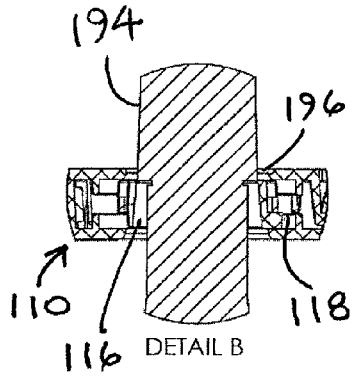
FIG. 53 is a detail B of cross-section A-A of the bottle neck and the second embodiment of the tag shown in FIG. 52.

FIGS. 49-51 show a bottle 190 with a body 192 and a neck 194 extending upwardly therefrom. The tag 110 shown in FIG. 25 is secured to the neck 194 of the bottle 190. FIG. 51 includes a cross-section A-A of the neck 194 and tag 110. FIG. 52 shows section A-A and illustrates how the tag 110 is secured below a perimetrical undercut 196 in the neck 194. Below the perimetrical undercut 196, the outer diameter of the neck 194 decreases. The attachment of the tag 110 under the perimetrical undercut 196 is further illustrated in Detail B in FIG. 53. After the tag 110 is positioned on the neck 194, the cable tie 118 is tightened to secure the retainer 116 around the neck 194.

Figure 54:
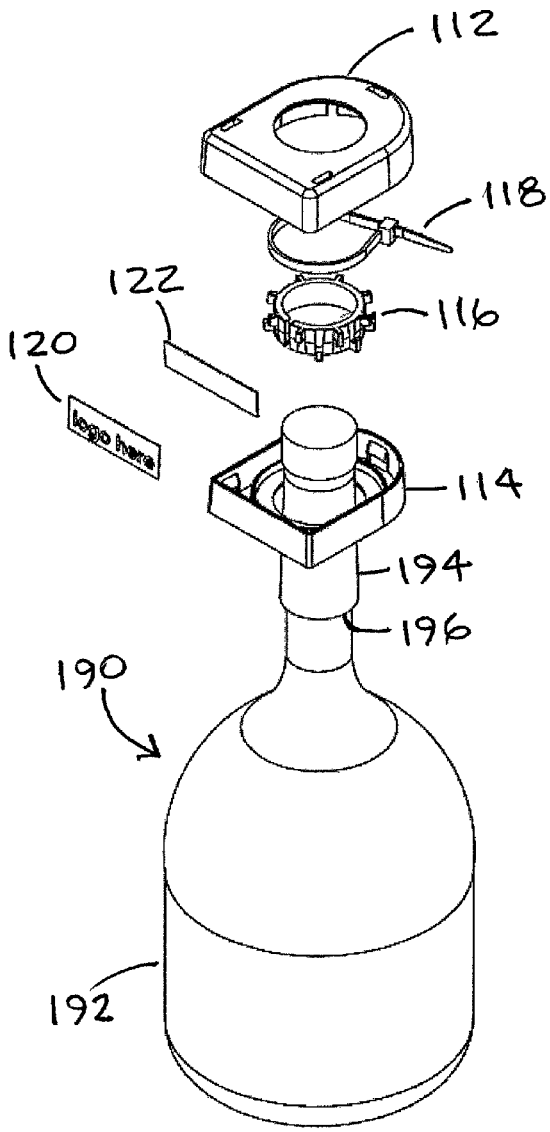
FIG. 54 is an exploded view of the second embodiment of the tag shown in FIG. 26 being secured to the neck of a bottle.
Figure 55:
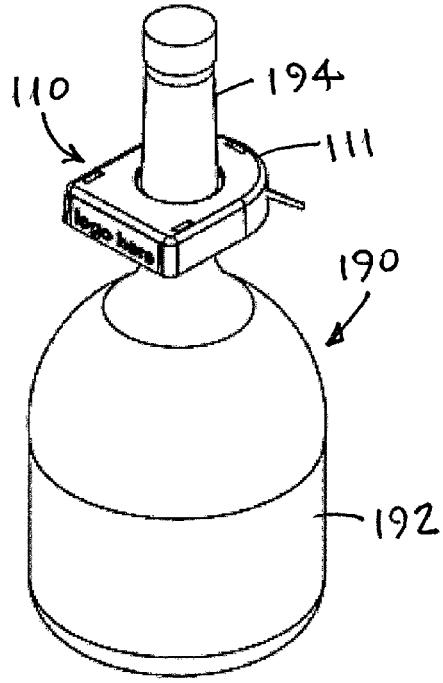
FIG. 55 is a perspective view of the second embodiment of the tag shown in FIG. 25 attached to the neck of a bottle.
Figure 56:
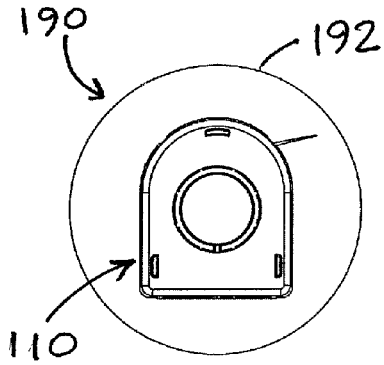
FIG. 56 is a top view of the second embodiment of the tag shown in FIG. 25 attached to the neck of a bottle.

FIG. 54 shows an exploded view of the tag 110 as it is being secured around the neck 194 of a bottle 190. A label 120 on the outer surface of the tag 110 and/or an electronic security device 122, such as an EAS or RFID device, can be placed in the tag 110. FIG. 55 shows the tag 110 after it is secured around the neck 194 of the bottle 190. FIG. 56 shows a top view of the tag 110 attached to the bottle 190. The size of the tag 110 is preferably designed so that it does not extend beyond the body 192 of the bottle 190 and does not interfere with other bottles when placed on shelves for sale to customers.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A tag for attachment to a neck of a bottle, wherein the neck has a perimetrical undercut thereabout, the tag comprising:

a housing formed by an upper housing portion and a lower housing portion defining an interior, each housing portion comprising an interior surface with an opening therethrough and a perimetrical wall extending from the interior surface to a top edge, wherein the perimetrical wall has at least one notch, wherein the openings are correspondingly located for receiving the neck of the bottle and the notches are correspondingly located to form a passage into the interior when the housing portions are joined together, and wherein the lower housing has an edge around the opening;

a retaining device having an adjustable aperture with a diameter; and a cable tie having a locking mechanism on one end and a tail on the opposite end, wherein the cable tie is disposed around the retaining device and the tail extends through the passage in the housing, wherein the neck of the bottle is inserted through the openings in the housings and the adjustable aperture of the retaining device, and wherein the cable tie is tightened to seat the retaining device in the perimetrical undercut of the neck to secure the tag to the bottle.

2. The tag according to claim 1, wherein the retaining device is a plurality of flexible fingers and wherein each flexible finger extends upwardly and inwardly from a base on the edge of the opening of the lower housing portion to a distal end.

3. The tag according to claim 2, wherein the opening in the lower housing portion has a diameter, and wherein the distal ends of flexible fingers on opposing sides of the opening are separated by a distance equal to less than 75% of the diameter of the opening in the lower housing portion.

4. The tag according to claim 2, wherein each of the flexible fingers has a front surface that contacts the bottle neck and a back surface, wherein one or more of the flexible fingers has a spur extending from the back surface, and wherein the cable tie is positioned between the bases of the flexible fingers and the spurs.

5. The tag according to claim 2, wherein the distal ends of the flexible fingers extend above the perimetrical wall of the lower housing portion.

6. The tag according to claim 2, wherein each housing portion further comprises one or more latching mechanisms extending from the interior surface, and wherein the latching mechanisms are correspondingly located and engage each other to attach the housing portions together.

7. The tag according to claim 2, wherein tightening the cable tie around the plurality of flexible fingers decreases the diameter of the adjustable aperture.

8. The tag according to claim 2, wherein the tag further comprises a radio frequency identification (RFID) tag or an electronic article surveillance (EAS) tag located inside the housing.

9. The tag according to claim 1, wherein the retaining device is a retainer comprising an annular wall with a gap, wherein the annular wall defines the adjustable aperture and the gap allows the diameter of the adjustable aperture to vary.

10. The tag according to claim 9, wherein the openings in the housing portions and the adjustable aperture in the retainer are aligned.

11. The tag according to claim 9, wherein the retainer further comprising a plurality of opposing members extend outwardly from the annular wall to distal ends, and wherein a track for receiving the cable tie is formed between the opposing members.

12. The tag according to claim 11, wherein the retainer further comprising a leg extends from the distal ends of two or more of the members in the direction of the opposing members to capture the cable tie.

13. The tag according to claim 9, wherein the lower housing portion further comprises an interior wall offset from and extending circumferentially around the edge.

14. The tag according to claim 13, wherein the retainer is positioned between the edge and the interior wall and the cable tie is located between the retainer and the interior wall.

15. The tag according to claim 9, wherein each housing portion further comprises one or more latching mechanisms extending from the interior surface, and wherein the latching mechanisms are correspondingly located and engage each other to attach the housing portions together.

16. The tag according to claim 9, wherein tightening the cable tie around the retainer decreases the diameter of the adjustable aperture.

17. The tag according to claim 9, wherein the tag further comprises a radio frequency identification (RFID) tag or an electronic article surveillance (EAS) tag located inside the housing.

18. A tag for attachment to a neck of a bottle, wherein the neck has a perimetrical undercut thereabout, the tag comprising:

a housing formed by an upper housing portion and a lower housing portion defining an interior, each housing portion comprising an interior surface with an opening therethrough and a perimetrical wall extending from the interior surface to a top edge, wherein the perimetrical wall has at least one notch, wherein each opening has a diameter and the openings are correspondingly located for receiving the neck of the bottle and the notches are correspondingly located to form a passage into the interior when the housing portions are joined together, wherein the lower housing has an edge around the opening, and wherein the housing provides support for an electronic security and/or identification device; and a retaining device having an adjustable aperture with a diameter and comprising a plurality of flexible fingers, wherein each flexible finger comprises a front surface and a back surface and extends upwardly and inwardly from a base on the edge of the opening of the lower housing portion to a distal end, and wherein one or more of the flexible fingers has a spur extending from the back surface; and a cable tie having a locking mechanism on one end and a tail on the opposite end, wherein the cable tie is disposed around the retaining device and the tail extends through the passage in the housing, wherein the cable tie is positioned between the bases of the flexible fingers and the spurs, and wherein tightening the cable tie around the plurality of flexible fingers decreases the diameter of the adjustable aperture, wherein the neck of the bottle is inserted through the openings in the housings and the adjustable aperture of the retaining device, and wherein the cable tie is tightened to seat the retaining device in the perimetrical undercut of the neck to secure the tag to the bottle.

19. The tag according to claim 18, wherein the tag further comprises a radio frequency identification (RFID) tag or an electronic article surveillance (EAS) tag located inside the housing.

20. A tag for attachment to a neck of a bottle, wherein the neck has a perimetrical undercut thereabout, the tag comprising:

a housing formed by an upper housing portion and a lower housing portion defining an interior, each housing portion comprising an interior surface with an opening therethrough, one or more latching mechanisms extending from the interior surface and a perimetrical wall having at least one notch and extending from the interior surface to a top edge, wherein the latching mechanisms are correspondingly located and engage each other to attach the housing portions together, wherein the openings in the housing portions are correspondingly located for receiving the neck of the bottle and the notches are correspondingly located to form a passage into the interior when the housing portions are joined together, wherein the lower housing portion further comprises an edge around the opening, and an interior wall offset from and extending circumferentially around the edge;

a retainer comprising an annular wall with a gap and an adjustable aperture with a diameter, wherein the annular wall defines the adjustable aperture and the gap allows the diameter of the adjustable aperture to vary, wherein the openings in the housing portions and the adjustable aperture in the retainer are aligned, and wherein the retainer is positioned between the edge and the interior wall of the lower housing portion; and a cable tie having a locking mechanism on one end and a tail on the opposite end, wherein the cable tie is disposed around the retaining device and the tail extends through the passage in the housing, wherein the neck of the bottle is inserted through the openings in the housings and the adjustable aperture of the retaining device, and wherein tightening the cable tie around the retainer decreases the diameter of the adjustable aperture and seats the retainer in the perimetrical undercut of the neck to secure the tag to the bottle.

21. The tag according to claim 20, wherein the tag further comprises a radio frequency identification (RFID) tag or an electronic article surveillance (EAS) tag located inside the housing.

* * * * *